United States Patent [19]

de Groot

[11] 4,055,356

[45] Oct. 25, 1977

[54] SAFETY SKI BINDING

[76] Inventor: Hans de Groot, 309 Wildman Arms, Swarthmore, Pa. 19081

[21] Appl. No.: 686,899

[22] Filed: May 17, 1976

[51] Int. Cl.[2] ..... A63C 9/08

[52] U.S. Cl. ..... 280/628

[58] Field of Search ..... 280/628, 623

[56] References Cited

U.S. PATENT DOCUMENTS

| | | | |
|---|---|---|---|
| 3,476,401 | 11/1969 | Unger | 280/628 |
| 3,610,650 | 6/1969 | Korger | 280/628 |
| 3,649,037 | 3/1972 | Vouthier | 280/628 |
| 3,709,510 | 1/1973 | Gotz | 280/628 |
| 3,876,219 | 4/1975 | Smolka | 280/628 |

*Primary Examiner*—Robert R. Song

*Attorney, Agent, or Firm*—Weiser, Stapler & Spivak

[57] ABSTRACT

Safety ski bindings include a boot retaining clip for engaging a ski boot at the heel and/or toe thereof. A toggle linkage system is operably connected to the boot retaining clip and is movable between a locked position for forcing the retaining clip against the boot to retain the boot on the ski, and an unlocked position for disengaging the retaining clip from the boot to permit the ski boot to separate from the ski. An actuated member is movable to unlock the linkage system to permit the linkage system to move into its unlocked position for releasing the retaining clip from the ski boot when the ski binding is displaced a certain distance relative to the ski in either one or both of two directions which are perpendicular to each other. Preloaded biasing means resist the displacement of the ski binding relative to the ski in one of the two directions, and a different preloaded biasing means resists the displacement of the binding relative to the ski in the other direction.

47 Claims, 15 Drawing Figures

FIG. 4
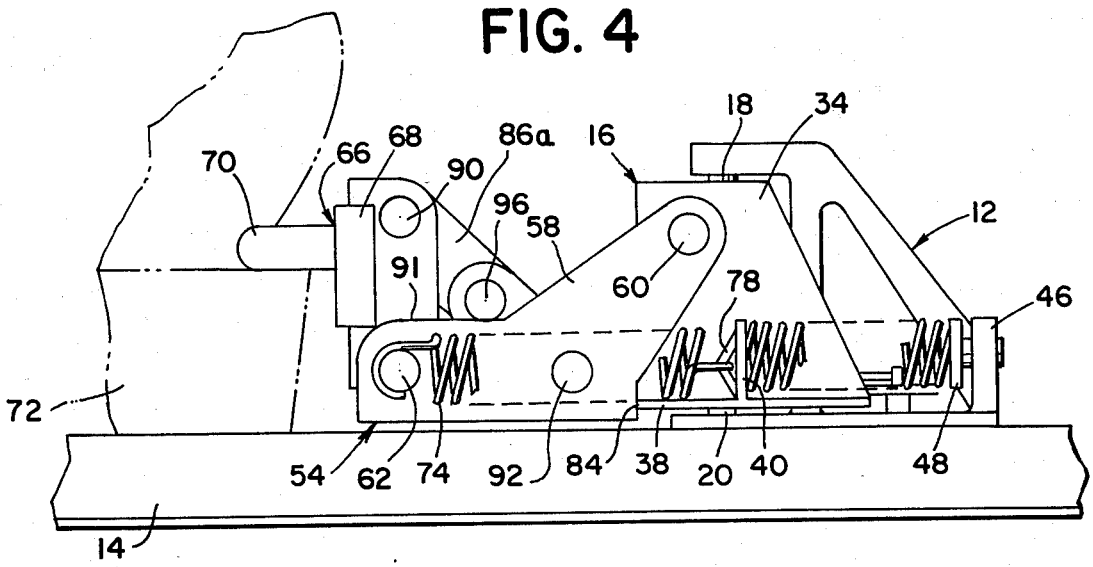
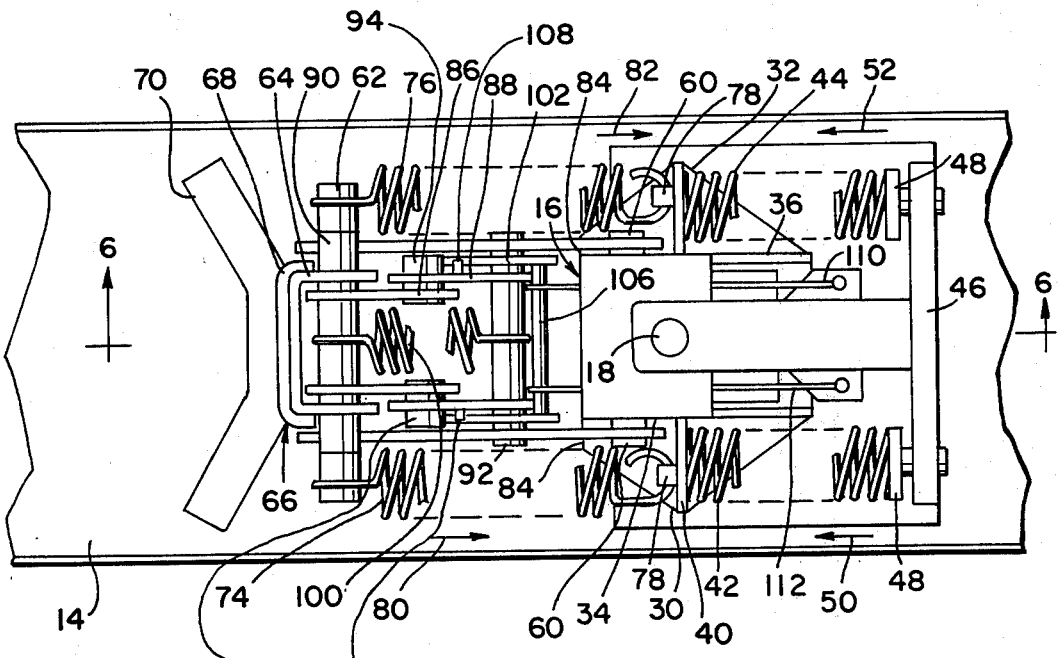
FIG. 5

SAFETY SKI BINDING

BACKGROUND OF THE INVENTION

1. Field of the Invention

This invention relates generally to safety ski bindings, and more particularly to safety ski bindings which release the ski boot from the ski when a force between the boot and the binding displaces the binding a certain distance relative to the ski in one or both of two directions which are perpendicular to each other.

2. Description of the Prior Art

The attributes of a well designed ski binding are well known in the prior art. Such bindings should provide a firm connection between the ski and the boot for skiing purposes, and should positively and reliably release the boot from the ski before injury causing levels of forces and/or moments are reached. Although positive and reliable release of the ski binding is an extremely important attribute, the ski binding should be capable of experiencing some relative motion with respect to the ski without releasing. This will prevent premature and undesirable release of the binding due to short duration shocks which are normally encountered during skiing.

In many cases the force imposed upon a ski binding will be a combination of a normal force resulting from a forward fall, and a transverse force resulting from a twisting, or torsional motion of the skier's body relative to the ski. Although the individual normal and transverse components of force may not be sufficiently high to cause an injury to a skier, the resultant force may be of an injury causing magnitude. Accordingly, it is highly desirable to design ski bindings so that they will reliably release when the resultant of several different forces imposed upon the binding reaches an injury causing level. Stating this another way, a well designed ski binding reacts to resultant forces, as well as to individual forces.

The most common safety ski bindings utilized today retain the ski boot to the ski at both the toe and the heel of the boot sole. The heel part of the binding most commonly includes a generally V-shape retaining clip which engages the upper surface of the sole, and releases the connection between the sole and the ski when a positive normal force imposed upon the retaining clip, as for instance in a forward fall, exceeds a certain preset level.

The toe part of the binding generally includes boot retaining sections which are rotatable about an axis which is normal to the boot supporting surface of the ski. These retaining sections release the toe of the boot when a torsional moment about an axis generally parallel to the upper surface of the ski exceeds a certain preset level. Toe bindings of the above-described type often require the boot to slide relative to the ski and/or the toe binding to actuate the toe binding for releasing the boot from the ski. The force required to affect this sliding motion is a function of the frictional resistance between the sliding surfaces. Unpredictable variations in frictional resistance exist because of dynamic or inertial forces which occur during skiing. Unpredictable variations in frictional resistance also occur as a result of the presence of dirt, snow and ice between the sliding surfaces. Moreover, temperature variations cause unpredictable variations in the frictional resistance between the sliding surfaces. In view of these unpredictable variations in frictional resistance the force required for laterally displacing the toe retaining part of the binding to release the boot is highly unpredictable.

A skier's weight is most often on the ball of his feet, and this creates a high normal force near the toe-retaining part of the binding. This results in high coulomb friction between the ski boot and ski. This high coulomb friction tends to resist the sliding action of the boot relative to the ski, and this resistance adversely affects the reliability of the release action of the toe binding during a twisting fall of the skier.

From the above discussion it should be apparent that the most desirable type of ski binding is one in which a sliding of the ski boot relative to the binding and to the ski is not relied upon to effect separation of the boot from the binding. Moreover, it is most desirable to provide the heel binding with a release mechanism which is responsive to excessive torsional forces creating a moment about an axis normal to the upper surface of the ski. Since a skier's weight is generally on the ball of his feet during skiing, the normal force imposed upon the ski by the boot is generally lowest at the heel. Accordingly, the frictional resistance to sliding motion between the ski boot and the ski is also generally lowest at the heel of the boot, and for that reason, it is most desirable to provide the release mechanism responsive to excessive torsional forces in the heel retaining part of the ski binding.

U.S. Pat. No. 3,620,545, issued to Korger on Nov. 16, 1971, relates to a ski binding safety clamp which engages a sole of a ski boot at its heel. The ski binding has a control mechanism for releasing the clamp from the boot when the upward normal forces and/or horizontal forces imposed upon the clamp exceed a preset level. The preset force level at which the clamp releases the boot is controlled by a single spring member. Accordingly, the preset force at which the safety clamp will release cannot be independently set for different types of forces imposed upon the clamp. Stating this another way, once the spring is set to provide a predetermined load at which the safety clamp will release during a forward fall of the skier, the load at which the safety clamp will release during a torsional fall, or a comined forward and torsional fall, is automatically determined. Accordingly, the Korger ski binding does not provide the skier with any latitude to independently setting the force levels at which the safety clamp will release under different types of load conditions.

The safety clamp of the Korger binding is retained in a boot clamping position by the engagement of cam surfaces on a catch support and a catch member. When the force upon the safety clamp exceeds a preset level the clamp will be moved to cause the cam surfaces of the catch support and catch member to slide relative to each other into a position in which the catch support disengages the catch member to permit a positive release of the safety clamp from the boot. This type of release mechanism requires fairly complicated cam designs to provide for the release of the catch member when either excessive horizontal forces or excessive normal forces are imposed upon the clamp. Moreover the construction of the Korger binding is such that the spring induced forces which resists the release of the safety clamp always acts through the camming surfaces of the catch support and the catch member. This creates undesirable friction of the camming surfaces caused by their sliding over each other and thus the release action will be adversely affected. In the event that a cam surface becomes slightly distorted because of this sliding action, the reliability of the release action of the safety clamp will be adversely affected.

It is known to provide a toggle link arrangement for retaining a safety clamp in a locked position against the sole of the ski boot, and for positively releasing the safety clamp when an excessive force is imposed upon it by the ski boot. Representative ski bindings employing toggle link arrangements are disclosed in U.S. Pat. Nos. 3,529,846, issued to Voster, and 3,550,996, issued to Marker. In these prior art ski bindings the safety clamp is rotatable about an axis disposed transversely to the length of the ski for both clamping and releasing the ski boot. Ski bindings employing a toggle link arrangement provide an extremely reliable release action of the safety clamp. However, prior art bindings employing a toggle link arrangement have been responsive only to upward normal forces imposed upon the clamp. In other words, when the clamp is employed to retain the heel of a ski boot against the ski, it is only designed to release when a positive normal force upon the clamp exceeds a certain level. The prior art safety clamps employing toggle link arrangements have not been designed to release upon the application of transverse forces to the clamp.

It is highly desirable to provide a ski binding with a safety clamp that is releasable from a ski boot by a toggle link arrangement, and which will be released by the toggle link arrangement when a torque in either one or both of two directions which are perpendicular to each other exceeds a preset level, and thereby all sliding of the different elements of the binding over each other has been eliminated. It is to this type of ski binding that the instant invention relates.

SUMMARY OF THE INVENTION

It is an object of this invention to provide a safety ski binding that includes a boot retaining member, preferably at the heel thereof, which will positively and reliably release a ski boot before body injuring levels of forces are imposed upon the retaining member in either one or both of two directions which are perpendicular to each other.

It is a further object of this invention to provide a safety ski binding whereby the boot releasing mechanism is not subjected to the forces which are imposed upon the boot retaining member.

It is a further object of this invention to provide a safety ski binding which minimizes the frictional energy spent between a ski and a ski boot and a boot retaining member of the ski binding during release of said retaining member from the boot.

It is a further object of this invention to provide a safety ski binding in which the components are susceptible to a minimum of wear, and therefore have a relatively long useful life.

It is a further object of this invention to provide a safety ski binding wherein all sliding friction between the parts has been eliminated.

The safety ski bindings of this invention include a retaining clip for engaging a ski boot preferably at least at the heel thereof. An operating means which may be a toggle linkage system, or other mechanical system, is operably connected to the retaining clip and is movable between a locked position for maintaining the retaining clip against the ski boot, and an unlocked position for releasing the retaining clip from the ski boot. An actuated member which may be a cam is provided for unlocking the toggle linkage system to permit it to move into its unlocked position. The retaining clip and toggle linkage system are connected to support means rotatable about first and second axis which are substantially perpendicular to each other. A biasing means resists rotational movement of the support means about its first axis of rotation, and different biasing means resists rotational movement of the support means about the second axis of rotation. The biasing means may be provided if desired with different characteristics for clockwise and counter-clockwise rotation. Actuating means are provided for moving the actuated member to unlock the toggle linkage system in response to rotational displacement of the support means about either one or both of the rotational axes. The rotational displacement of the support means takes place when a force is imposed upon it to overcome the force of the biasing means resisting that displacement. In the preferred embodiments of this invention one rotational axis of the support means is disposed substantially transverse to the long dimension of the ski to permit the retaining clip to pivot upwardly relative to the ski in response to a positive normal force imposed upon the clip, such as may occur in a forward fall of a skier. Preferably the other rotational axis of the support means is generally perpendicular to the upper surface of the ski. This permits the retaining clip to move laterally with respect to the ski upon the imposition of a force on the retaining clip which is generally parallel to the upper surface of the ski and generally transverse to the long dimension of said ski. This latter force can be imposed upon the retaining clip during a torsional, or twisting fall of a skier.

The ski bindings in accordance with the preferred embodiments of this invention provide independent biasing means for resisting displacement of a ski boot retaining clip in two directions which are perpendicular to each other. Accordingly, the force required to displace the retaining clip in one direction is determined by different biasing means than the force required to displace the retaining clip in the other direction. This permits greater flexibility in properly adjusting the retaining clip than can be achieved in safety ski bindings of the type disclosed in the Korger patent.

In preferred embodiment of this invention, the toggle linkage assembly is actuated by a cam which is normally disposed out of engagement with said assembly. This cam and its associated releasing mechanism are not subjected to the forces which are required to overcome the displacement resisting forces created by the biasing means. Upon displacement of the ski binding, as described above, the cam will be rotated into engagement with the toggle linkage assembly for unlocking it. Specifically, the cam engages the toggle linkage assembly together from an overcenter and locked position to an undercenter and unlocked position. A resilient member associated with the links will force them into the unlocked position when the axle connecting them together is moved into its undercenter position. This force will be enhanced by the force imposed on the binding. Only a small displacement is required to move the axle from its overcenter position to undercenter position.

The forces on the retaining clip will reinforce the holding action in the overcenter position of the toggle links. Similarly, the forces on the retaining clip will reinforce the releasing action in the undercenter position of the toggle links.

The cam employed to actuate the links of the toggle linkage assembly rotates through a certain angle prior to engaging the toggle linkage assembly for unlocking the links. That angle can be altered by changing the relative position between the toggle linkage assembly and the cam surface which actuates said assembly. Accordingly, the cam can be set to permit a certain amount of displacement of the support means of the binding relative to the ski before the boot retaining clip will be released from the boot. This permits the binding to be adjusted so that small excursions of the support means relative to the ski will not release the ski boot. Such small displacements generally occur as a result of the imposition of short duration forces upon the retaining clip by the ski boot. These short duration forces can occur when a skier is skiing over bumpy or rocky terrain. It is not desired to have the ski separate from the ski boot when the forces imposed upon the binding are due only to the condition of the terrain, and do not reach injury causing levels.

In the most preferred embodiments of this invention the toggle linkage assembly is in the form of a four-bar linkage system in a two link toggle arrangement. The boot retaining clip is connected to one of the links, and that link moves away from the bootsole in a generally longitudinal direction when releasing the boot from the ski. This longitudinal direction is generally perpendicular to the directions of all of the forces against which the binding must safeguard the skier. This factor minimizes the frictional energy which is spent between the ski boot and the retaining clip during release of the boot.

It is within the scope of this invention to employ the above-described binding to connect both the toe and the heel of a ski boot to a ski. The combined action of the rotation of both bindings about their respective transverse and normal axes safeguards the skier against excessive moments about axes which are generally transverse and generally normal and generally longitudinal to the length of the ski. In this manner a skier is safeguarded against every possible moment and/or force which may be damaging to his body. Moreover, since either the toe or the heel retaining bindings can rotate about an axis which is generally normal to the upper surface of the ski, the effect of friction between the sole of the ski boot and the top surface of the ski during release of the connection between the boot and the ski is minimized. Specifically, the particular binding at which the normal force imposed upon the ski is the lowest will be the binding that will make the only or greatest rotational excursion about its normal axis, and thus release.

The biasing means which resist the displacement of the binding relative to the ski can be strain dependent elements such as springs, or strain-rate dependent elements made from metals, elastomers, or operable with fluids.

In one embodiment of this invention the normal axis about which the binding rotates is positioned outside of the area occupied by the sole of the ski boot. In a second embodiment of this invention the normal axis of rotation of the ski binding is positioned within the area occupied by the sole of the boot. In the second embodiment of the invention the normal axis of rotation preferably is placed in line with the fexural center of the skier's leg to prevent the leg from bending when the torque imposed upon the leg is about an axis generally perpendicular to the upper surface of the ski. This minimizes the possibility of leg injuries.

Most preferably the normal axis or rotation of the binding is provided within the area occupied by the sole of the boot by mounting a plate to the ski on a generally vertically disposed pivotal axle, and by connecting this plate to at least the heel retaining part of the binding. The function of this plate is to locate the normal axis in relation to the binding. The plate only transmits forces in the plane of the plate (no bending moments or perpendicular forces). The plate must flex when the ski flexes. This plate can also be employed to connect an identical toe retaining binding. This arrangement will isolate the ski boot from the surface of the ski. In this manner all frictional effects between the ski boot, ski and binding are virtually eliminated. In this latter construction the binding means can be adjusted to permit both the toe and heel retaining parts of the binding to release simultaneously. This will provide a total release of the ski boot from the ski.

It is further an object of this invention to provide a safety ski binding whereby all connections between the elements of the binding are rotary connections or pivot points. Therefore all sliding between the elements of the binding over each other has been eliminated and the binding is therefore free of sliding friction.

Other objects and advantages of this invention will become apparent upon reading the detailed description which follows, taken in conjunction with the drawings.

BRIEF DESCRIPTION OF THE DRAWINGS

FIG. 4 is a side elevation view of the ski binding shown in FIG. 1;

FIG. 5 is a plan view of the ski binding shown in FIG. 1;

DESCRIPTION OF THE PREFERRED EMBODIMENTS OF THE INVENTION

Figures 1, 15:
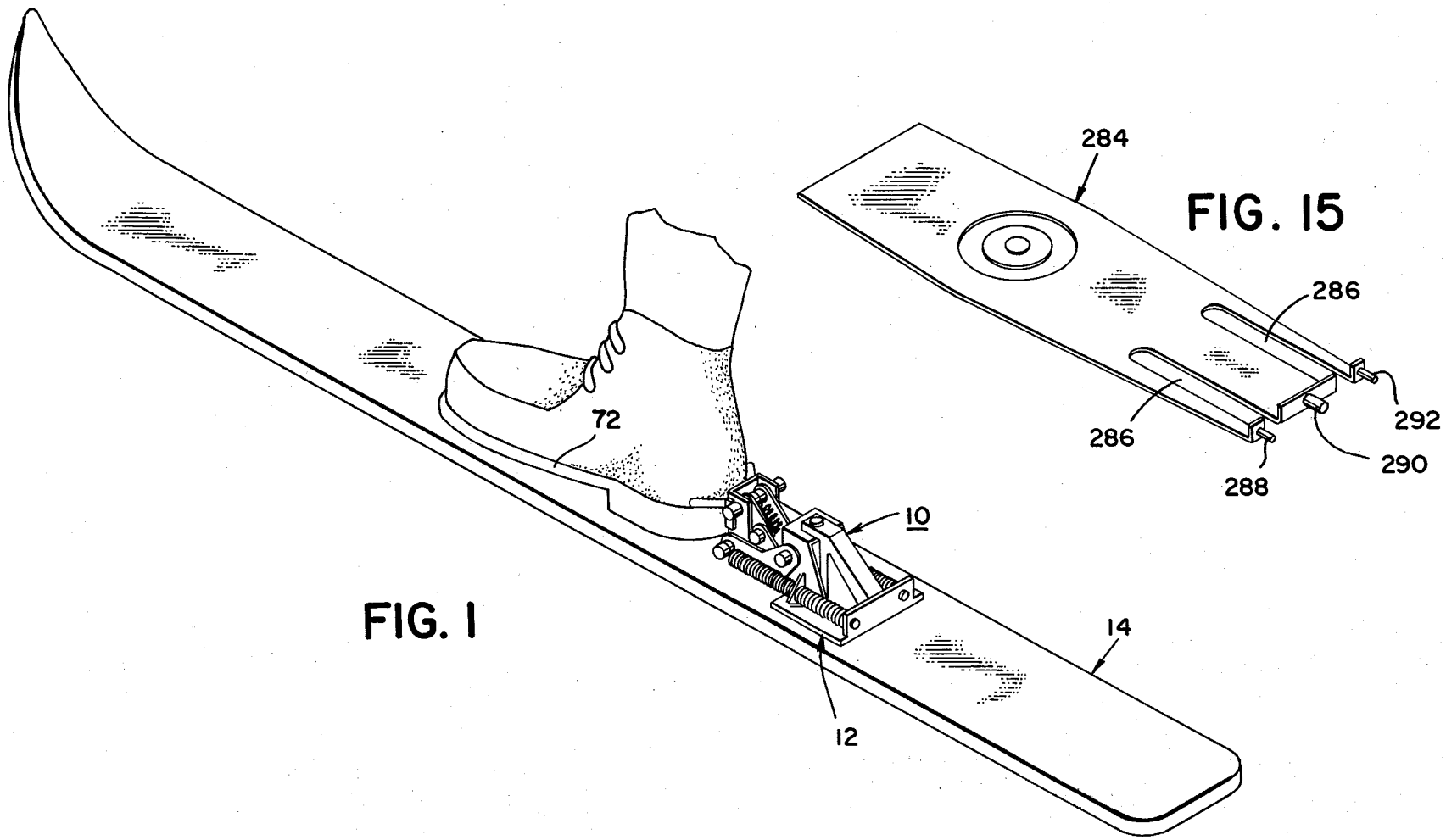
FIG. 1 is an isometric view showing a safety ski binding of this invention employed to retain the heel of a boot on a ski.
FIG. 15 is an isometric view of a boot supporting plate employed in the ski binding shown in FIG. 11.

Referring to FIG. 1, a heel retaining ski binding 10 in accordance with this invention is shown. The binding includes a mounting section 12 adhered to the upper surface of ski 14 by screws or other similar fastening means (not shown).

Figure 2:
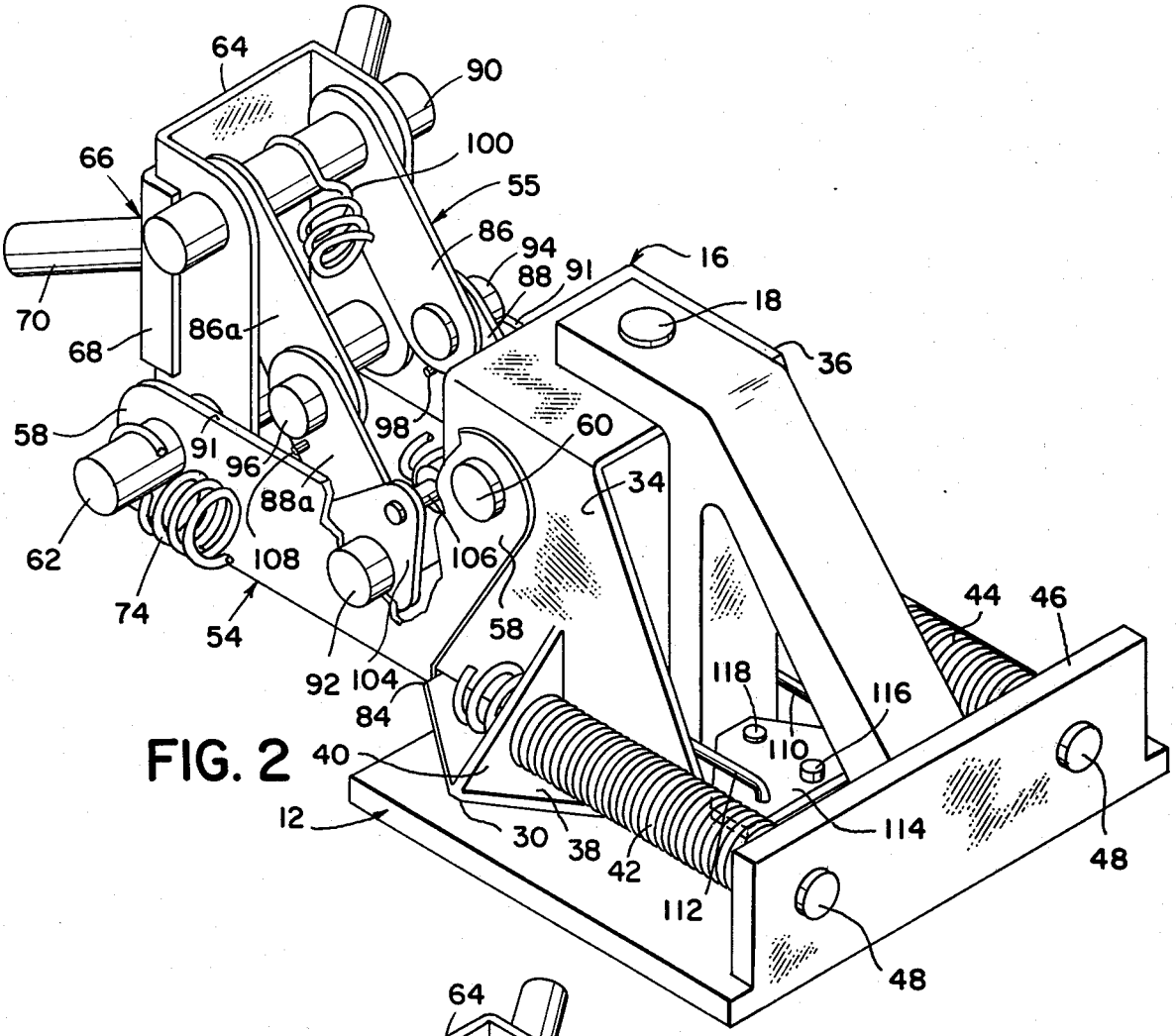
FIG. 2 is an isometric view of the ski binding shown in FIG. 1 with parts broken away to show details of construction.
Figure 6:
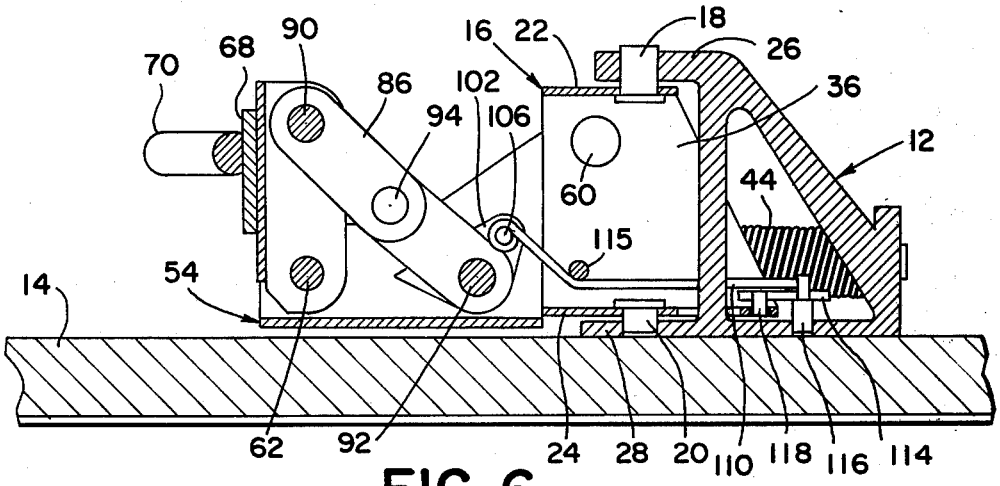
FIG. 6 is a sectional view taken along line 6—6 of FIG. 5.

Referring to FIGS. 2, 4 and 6, a binding carrier 16 is rotatably connected to the mounting section 12. The rotatable connection is provided by vertically aligned studs 18 and 20 which connect upper and lower walls 22 and 24 of the binding carrier to supporting arm 26 and lower deck 28, respectively, of the mounting section 12 (FIG. 6).

Referring to FIGS. 2, 4 and 5 transversely spaced supports 30 and 32 are connected to side walls 34 and 36 of the binding carrier 16. Each support includes a horizontal platform 38 and a vertical member 40. Biasing means or spring members 42 and 44 are mounted in a compressed condition between upstanding flange 46 of the mounting section 12 and respective vertical members 40 of the transversely spaced supports 30 and 32. Nuts 48 are rotatable adjacent one end of each of the spring members 42 and 44 to permit adjustment of the preload on said spring members. The nuts or adjusting means 48 may be individually adjusted for clockwise or counterclockwise rotation. The preloaded spring members 42 and 44 apply a force to the binder carrier 16 in the direction of arrows 50 and 52 (FIG. 5) to restrain the binding carrier from rotating about the vertical axis provided by the studs 18 and 20. Accordingly, the binding carrier 16 can only rotate about its vertical axis when a transverse force of sufficient magnitude to overcome the biasing force of one of the spring members 42 or 44 is imposed upon the ski binding. The manner in which the binding carrier 16 is rotated to effect release of the ski binding will be described in detail later in this application.

Referring to FIGS. 2–5, a support means or a toggle bracket 54 is generally U-shaped in transverse cross section and is adapted to support a toggle linkage system 55 in a manner which will be described in detail later. The toggle bracket 54 includes a horizontal base 56 and transversely spaced, vertical upstanding legs 58. The legs 58 are pivotally connected through transversely aligned studs 60 to side walls 34 and 36 of the binding carrier 16.

A transversely extending axle 62 extends through transversely spaced legs of a generally U-shaped retaining link 64 and through the upstanding legs 58 of the toggle bracket 54. The retaining link 64 is rotatable about the axle 62 and has a boot retainer 66 connected to it. The boot retainer 66 includes a generally U-shaped mounting bracket 68 which is mounted for vertical adjustment on the retaining link 64 in a well known manner (not shown). The boot retainer 66 further includes a boot retaining clip 70 secured to the bracket 68, and this clip is adapted to engage a boot 72 at the heel or toe thereof (FIG. 4).

Referring to FIGS. 2, 4 and 5, transversely spaced, tensioned spring members 74 and 76 are connected at opposed ends to hooks 78 attached to the vertical members 40 of the transversely spaced supports 30 and 32 of the binding carrier 16, and to the ends of the axle 62. The tensioned spring members 74 and 76 exert forces on the toggle bracket 54 in the direction of arrows 80 and 82, respectively, to restrain the toggle bracket from rotating about the transverse axis provided by studs 60. The horizontal platforms 38, which form a part of the binding carrier 16, each include an end wall 84 for engaging rear surfaces of the toggle bracket 54 to act as a stop for limiting the movement of said toggle bracket about studs 60 when said bracket is under the influence of the tensioning force imposed by the tensioned spring members 74 and 76. Rotational motion of the toggle bracket 54 about this transverse axis can only take plate when an upward force of sufficient magnitude to overcome the biasing action of the tensioned spring members 74 and 76 is imposed on the toggle bracket 54.

Figure 3:
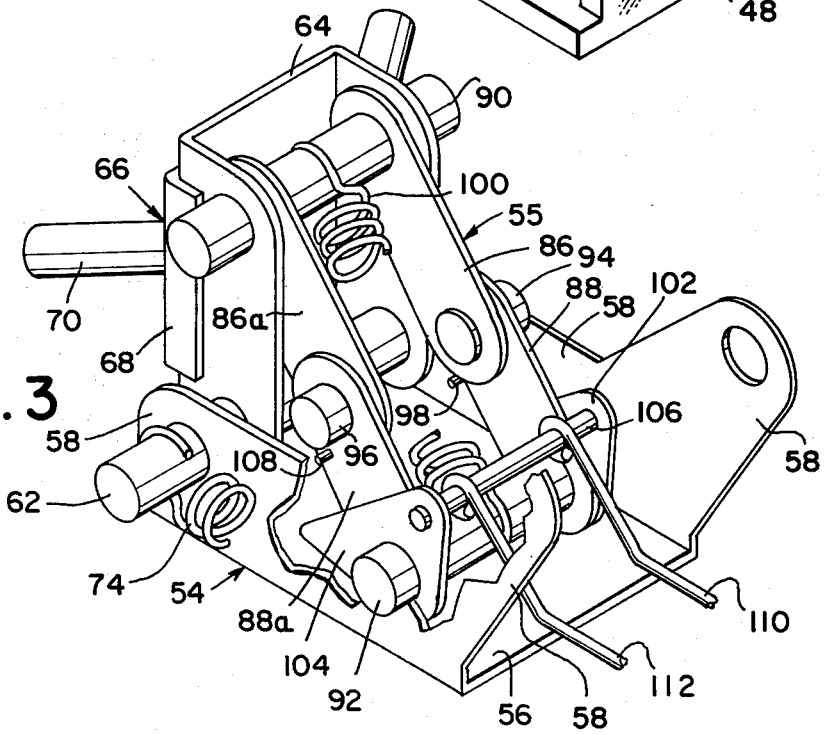
FIG. 3 is an isometric view of ths linkage system and release mechanism employed in the ski binding shown in FIG. 1 with parts broken away to show details of construction.

Referring to FIGS. 2 and 3, the operating means or toggle linkage system 55 is in the form of a four bar linkage including a first set of toggle links 86 and 88, and an identical set of toggle links **86*a* and 88*a* transversely spaced from, and operably connected to said first set of toggle links. Specifically, a transversely extending axle 90 extends through one end of the toggle links 86 and 86*a* and through the transversely spaced legs of the retaining link 64. The transverse ends of the axle 90 overlie the upper surfaces 91 of the upstanding legs 58 of the toggle bracket 54. A transversely extending axle 92 extends through the ends to toggle links 88 and 88*a*, and also through the upstanding vertical legs 58 of the toggle bracket 54. Transversely spaced studs 94 and 96 connect overlapping ends of toggle links 86 and 88 together, and toggle links 86*a* and 88*a* together, respectively. These studs terminate short of the upstanding legs 58 of the toggle bracket 54. The toggle links of each set are rotatable relative to each other about the axes provided by studs 94 and 96 in a manner which will be described later in the application. From the above description it can be seen that the transverse axis of rotation provided by axles 62, 90, 92, and the transversely spaced studs 94 and 96 are all parallel to each other and parallel to the upper surface of the ski 14. (FIG. 1**)

Referring again to FIGS. 2 and 3, toggle stops, in the form of pins 98 (only one of which is shown), extend inwardly from the upstanding legs 58 of the toggle bracket 54. A tensioned spring member 100 is connected to the axles 90 and 92 to urge both sets of toggle links respective pins 98. In this condition the transverse axes of rotation provided by the studs 94 and 96 are in an overcenter position in relation to the line of force imposed between the axles 90 and 92 by the spring member 100. The toggle links are in a locked position when this overcenter condition exists to lock the boot retaining clip 70 against the heel or toe of boot 72.

Referring to FIG. 3, actuated means in the form of identical cam members 102 and 104 are freely rotatable on the axle 92 intermediate each set of toggle links and an adjacent leg 58 of the toggle bracket 54. A transversely extending rod 106 rigidly connects the transversely spaced cams 102 and 104 together. Transversely extending pins 108 are connected to links 88 and **88*a* and overlie respective cams 102 and 104. Only the pin 108 connected to link 88*a* is shown in FIG. 3. The cams 102 and 104 are adapted to be actuated for engaging the pins 108 to release the locked position of the toggle linkage system 55** in a manner which will be described later in the application.

Referring to FIGS. 2, 3, 5 and 6 actuating means in the form of transversely spaced cables 110 and 112 each have one end connected to the rod 106, which connects the cams 102 and 104 together, and the other end connected to a swivel plate or force modification means 114 (FIGS. 2 and 6). A section of each cable 110 and 112 is trained about a roller 115 connected to carrier 16. The swivel plate 114 is rotatable about an axle 116 which is connected to the lower deck 28 of the mounting section 12. A downwardly extending pin 118 secured to the swivel plate is positioned within a clearance opening in the lower wall 24 of the binding carrier 16. It is noteworthy that the actuated means 102, 104 and the actuating means 110, 112 are not subjected to any of the forces which are acting upon the boot retaining member. In use, the actuating means are not being loaded by the usual skiing forces.

The connection of the different elements of ski binding 10 to each other is by means of rotary connections or pivot points. Therefore all sliding friction between the elements of said binding is eliminated.

The operation of the ski binding 10 will now be described. In connection with this description the actuation and movement of the first set of toggle links; namely, toggle links 86 and 88, will be described. It should be understood that the motion of toggle links **86*a* and 88*b* will be identical to that of the toggle links 86 and 88 by virtue of the fact that they are of an identical construction, and are operably connected together to move as a unit with the links 86 and 88. Moreover, the mechanism for actuating the set of toggle links 86*a* and 88*b* is identical to the mechanism which actuates the set of toggle links 86 and 88.**

Figure 7:
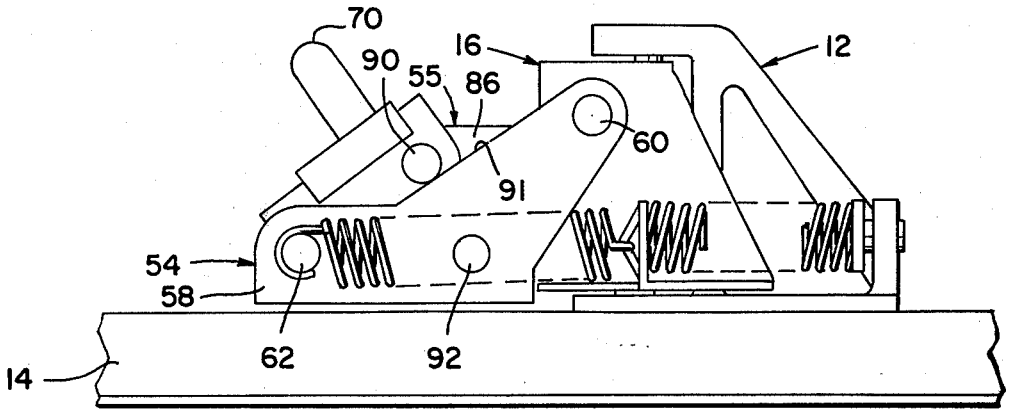
FIG. 7 is a side elevation view similar to FIG. 4, but showing the binding in the condition it assumes for releasing the ski boot.

When an upward normal force of sufficient magnitude to overcome the biasing action of the tensioned spring members 74 and 76 acts upon the boot retaining clip 70 the toggle bracket 54 will be rotated in a clockwise direction, as viewed in FIG. 6, about the transverse axis provided by studs 60. This motion occurs because the upward normal force imposed upon the boot retaining clip 70 is transmitted through the U-shape mounting bracket 68 and the retaining link 64 to the toggle bracket 54 through axle 62. During this rotational motion of the toggle bracket the transversely spaced cables 110 and 112 connected to the rod 106 joining cams 102 and 104 together will cause said rod to remain in the same position relative to the mounting section 12 of the ski binding. However, axle 92, by virtue of being connected to the toggle bracket 54, will rotate about the transverse axis provided by the studs 60. This rotational motion will cause cam 102 to rotate about the axle 92 into engagement with the transversely extending pin 108 connected to the toggle link 88. As the cam continues to rotate it will force the transverse axis provided by stud 94 into an undercenter position with respect to the line of force imposed between the axles 90 and 92 by the tensioned spring member 100. After the stud 94 is moved to its undercenter position the force imposed upon the linkage by the tensioned spring member 100 will positively and reliably cause the toggle links 86 and 88 to snap into the boot releasing position shown in FIG. 7. In that position the boot retaining clip 70 is disengaged from the boot as a result of the rotation of the retaining link 64 about the transversely extending axle 62. Movement of the retaining clip 70 is limited by the engagement of axle 90 with the upper surface 91 of legs 58 of the toggle bracket 54. The release motion of the retaining clip 70 can be defined as a generally longitudinal motion parallel to the longitudinal axes of the ski. This motion is generally perpendicular to the upward release force imposed upon the boot retaining clip 70 by the ski boot. This relationship between the direction of movement of the boot retaining clip relative to the direction of the force applied to it minimizes the frictional energy which is spent between the ski boot and the binding during release of said binding.

When a pure transverse force of sufficient magnitude to overcome the actions of one of the spring members 42 and 44, let us assume spring 42, acts on the boot retainer 66 through its force transmitting connection with boot retaining clip 70, the binding carrier 16 will rotate counterclockwise, as viewed in FIG. 5. The counterclockwise rotation of the binding carrier 16 will rotate the swivel plate 144 clockwise, causing cable 110 to pull upon the cam connecting rod 106 to cause cam 102 to rotate about the transversely extending axle 92. Continued rotation of the cam 102 will cause it to contact the pin 108 which is connected to the toggle link 88 to force the stud 94 from an overcenter and locked position into an undercenter position. When the stud 94 is in its undercenter position the force imposed upon the axles 90 and 92 by the tensioned spring member 100 will snap the toggle links 86 and 88 into their released position shown in FIG. 7. Accordingly, the motion of the boot retaining clip 70 in releasing the boot when an excessive transverse force is imposed upon the clip is identical to the motion of the boot retaining clip when released by the action of an excessive normal force. Again, this release motion is substantially perpendicular to the transverse force imposed upon the binding. Therefore the frictional energy which is spent between the boot and the binding during release is miminized in the same manner described above in connection with the release of the binding under a purely normal force imposed upon the boot retaining clip 70.

Most commonly the forces imposed upon the boot retaining clip 70 will be a combination of normal and transverse forces. In other words, it is rare for the forces imposed upon the boot retaining clip to be either purely normal or purely transverse. The ski binding of this invention is also responsive to resultant forces imposed upon the retaining clip 70 by the combined action of normal and transverse forces. A combination of such forces generally is transmitted to the boot retaining clip during a twisting-type fall. In other words, the cam 102 will be forced to rotate as a result of the rotation of the toggle bracket 54 about the transverse axis provided by stud 60, and by the rotational motion of the binding carrier 16 about the vertical axis provided by studs 18 and 20. The rotational motion of the cam 102 will be an additive motion which is determined by the combined rotation in the transverse and vertical directions. Accordingly, even though neither of the above rotations would be sufficient by itself to cause release of the boot retaining clip, the combined rotations will permit release of the clip to prevent injury to a skier's leg during a twisting-type fall.

The heel retaining ski binding 10 of this invention can be employed in conjunction with any of the conventional toe bindings available on the market. Alternatively, the toe binding can be of an identical construction to the heel retaining ski binding 10. In this latter case the ski binding would most reliably release since it will be responsive to forces and moments in all conceivable direction.

Figure 8:
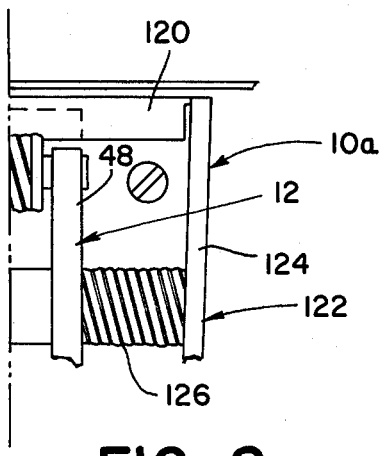
FIG. 8 is a partial plan view of a modified ski binding of this invention.
Figure 9:
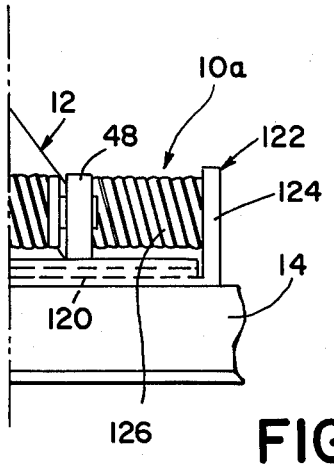
FIG. 9 is a side elevation view of the ski binding shown in FIG. 8.

Referring to FIGS. 8 and 9, a modification **10*a* of the ski binding 10 is shown. In this embodiment of the invention the mounting section 12 is positioned within transversely spaced slideways 120 of a binding slide 122. The binding slide 122 includes an upstanding rear wall 124, and a compressed spring member 126 is positioned between this rear wall and the upstanding flange 48 of the base 12. Except for the above described features, the ski binding 10*a* is identical to the ski binding 10.**

The compressed spring member 126 biases, or forces the mounting section 12 toward the the toe retaining binding (not shown) of the ski. This forward thrust assures that the toe of the boot will remain engaged by the toe binding during flexure of the ski. It should be realized that flexure of the ski commonly occurs under normal skiing conditions, and that release of the ski from the boot under such conditions is not desired.

Figure 10:
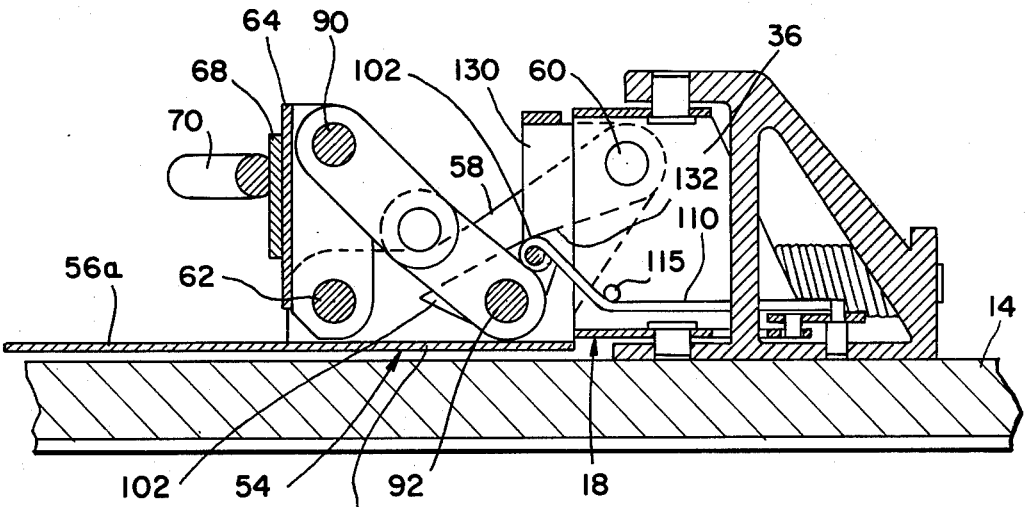
FIG. 10 is a sectional view similar to FIG. 6, but showing a further modified ski binding in accordance with this invention.

Referring to FIG. 10, a further modification of the ski binding 10 is shown. In this embodiment a quick release bracket 130 is rotatably mounted about stud 60, and is positioned between a side wall 36 of the binding carrier 16 and an adjacent upstanding leg 58 of the toggle bracket 54. In this position the lower extremity 132 of the release bracket 130 can be forced into engagement with an upper rear surface of the cam 102 to force the cam to rotate about axle 92 and break the locked condition of the toggle links.

The toggle brackets 54 of the modified safety ski binding shown in FIG. 10 includes horizontal base **56*a* which extends forwardly beyond the boot retaining clip 70. This extended base provides a surface for supporting the bottom of the boot sole in the heel region thereof to isolate the heel of the boot from the upper surface of the ski. This arrangement eliminates relative movement between the boot sole and the upper surface of the ski during transverse movements of the heel relative to the ski. Accordingly, the frictional resistance to transverse motion of the ski boot relative to the ski is eliminated. In all other respects the safety ski binding shown in FIG. 10 is identical to the safety ski binding 10**.

Referring to FIGS. 11 through 15, a further embodiment of a safety ski binding 200 is disclosed. The operation of this safety ski binding is very similar to the operation of the various safety ski bindings described eariler. The major difference between the safety ski binding 200 and the previously describes ski bindings is that the normal, or vertical axis of rotation of the ski binding 200 intersects the sole of the ski boot. Consequently cables, or other similar connecting devices must be employed to connect the binding carrier to the mounting section.

Figure 11:
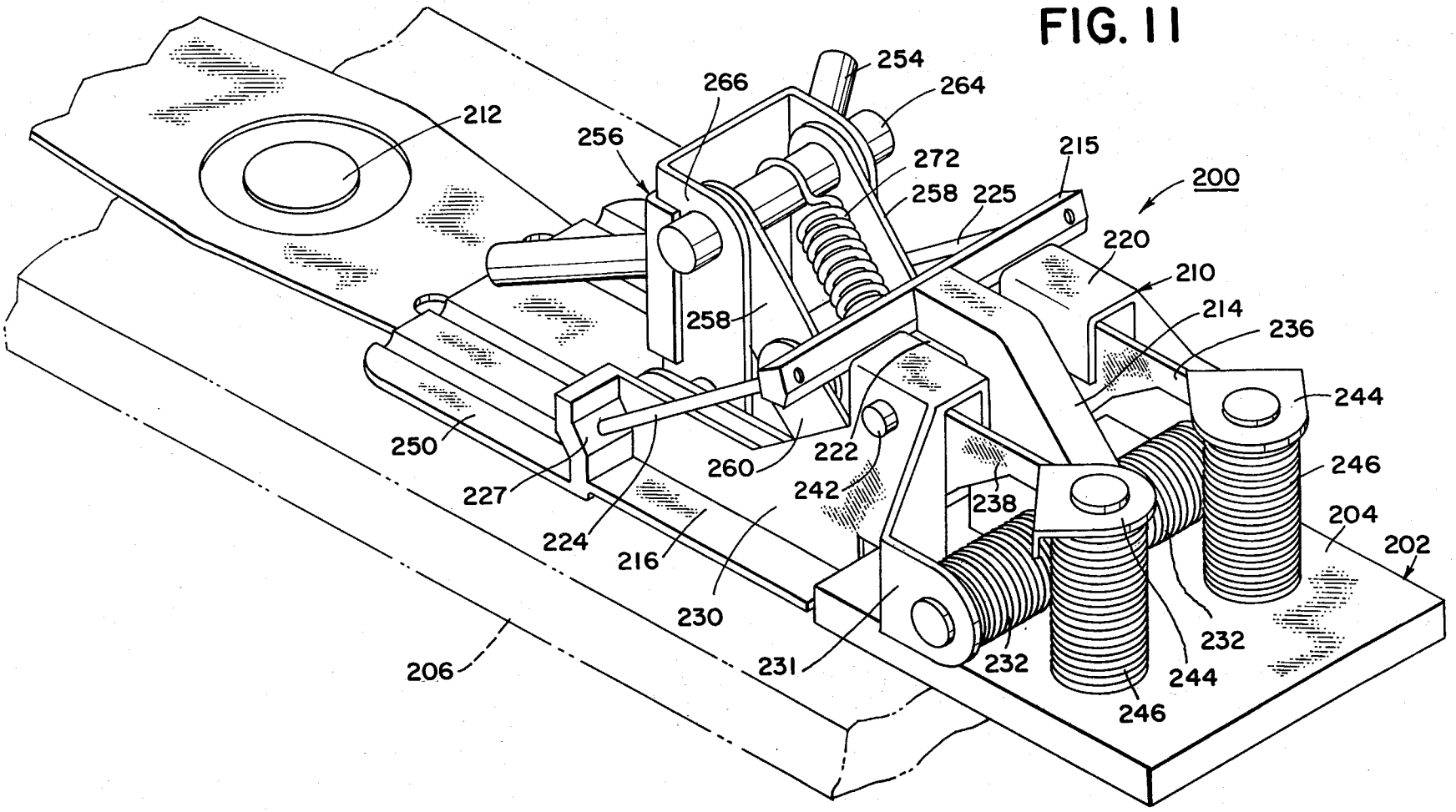
FIG. 11 is an isometric view of a further embodiment of this invention.
Figure 13:
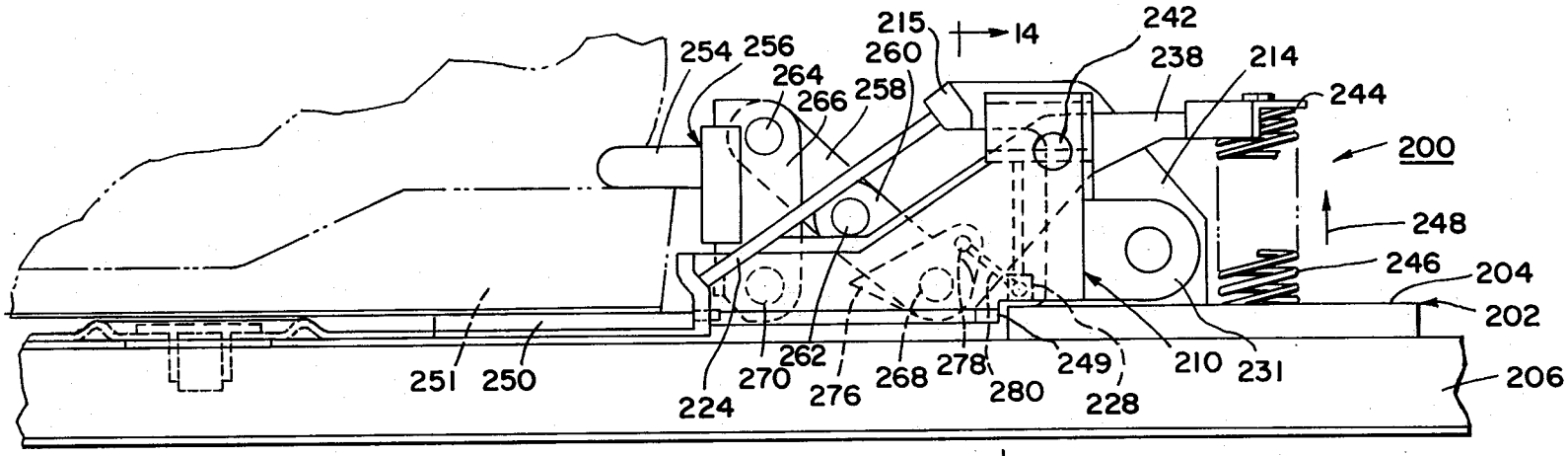
FIG. 13 is a side elevation view of the ski binding taken along line 13—13 of FIG. 12.
Figure 12:
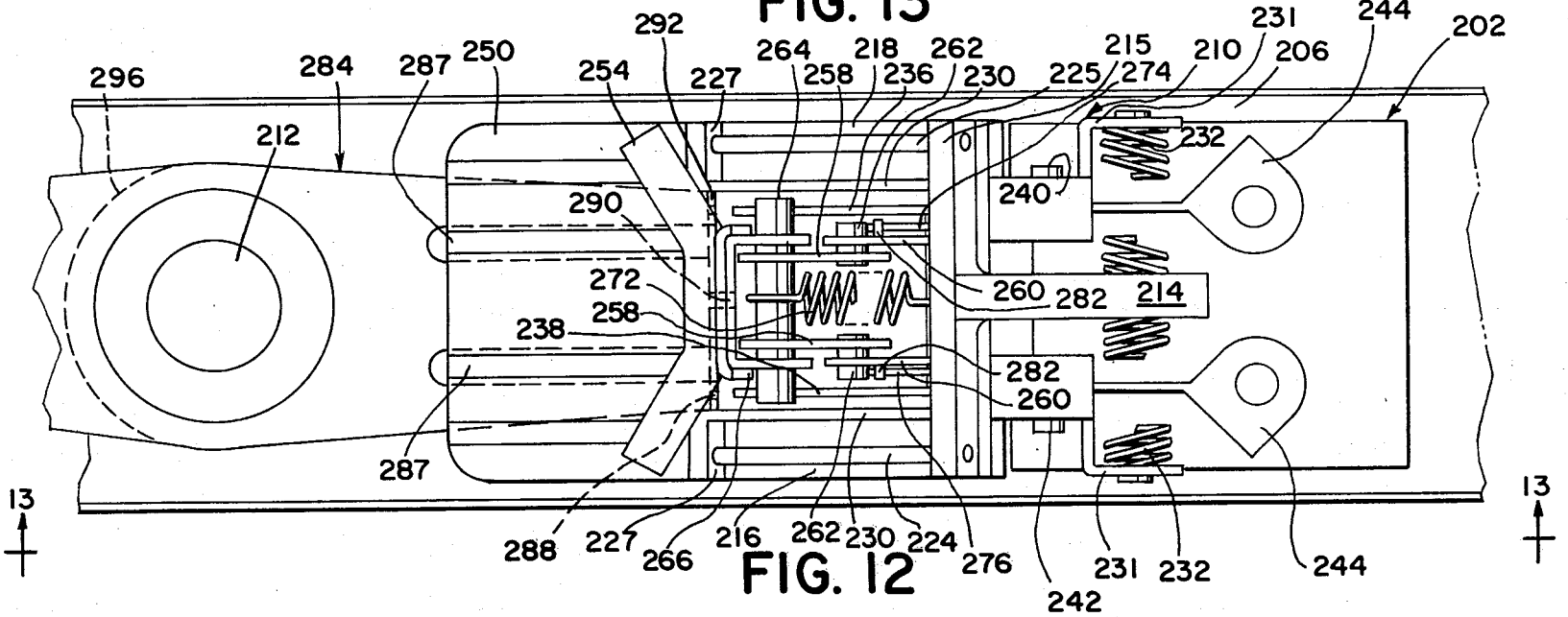
FIG. 12 is a plan view of the ski binding shown in FIG. 11.

Referring to FIGS. 11–13, a heel retaining safety ski binding 200 includes a mounting section in the form of a cable post 202. The cable post has a lower deck 204 which is fastened to the upper surface of ski 206 by screws, or other well known fastening means (not shown). A binding carrier 210 is supported on the cable post 202 for rotation about a vertical axis provided by a stud 212 underlying the ski boot of a skier.

Figure 14:
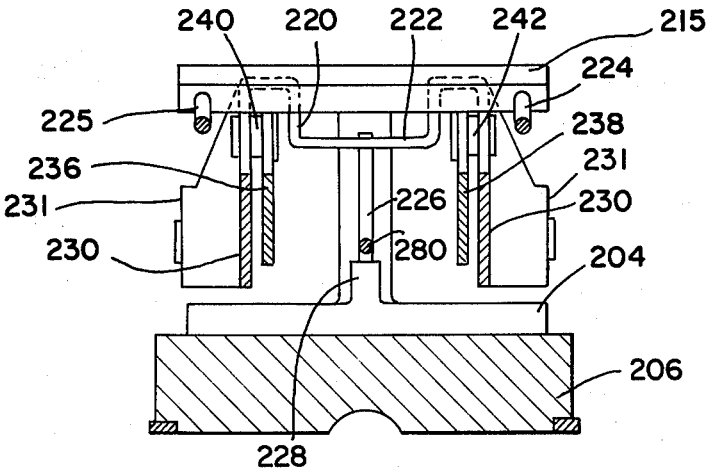
FIG. 14 is a sectional view of the ski binding taken along line 14—14 of FIG. 13.

The cable post 202 includes a vertically upstanding support arm 214 intermediate side margins of the lower deck 204. The support arm 214 terminates in a transversely extending cable support member 215. The binding carrier 210 includes transversely spaced side members 216 and 218 integrally joined by an upper wall 220 which is generally U-shaped (FIGS. 11 and 14). The upper wall 220 includes a base section 222 which passes under a section of the support arm 214 rearwardly of the cable support member 215.

Referring to FIGS. 11, 12 and 14, the binding carrier 210 is supported on the cable post 202 by cables 224, 225 and 226. Cables 224 and 225 are transversely spaced from each other, and are connected at one end to the cable support member 215, and at the other end to upstanding sections 227 of the binding carrier 210. Cable 226 is disposed rearwardly intermediate cables 224 and 225, and is connected to the base section 222 of the binding carrier upper wall 220, and a raised abutment 228 of the lower deck 204 of the cable post 202.

Referring to FIGS. 11, 12 and 14, each side member 216 and 218 of the binding carrier 210 includes a vertically upstanding side wall 230. Spring member retaining arms 231 extend rearwardly from each of the side walls 230, and spring members 232 are disposed in a compressed condition between the retaining arms 231 of the binding carrier, and the vertical support arm 214 of the cable post 202. These spring members resist displacement of the binding carrier 210 about the vertical axis provided by stud 212.

Referring to FIGS. 11 – 14, a toggle bracket includes transversely spaced toggle link support legs 236 and 238 positioned inside of the side walls 230 of the binding carrier 210. The legs 236 and 238 are rotatable about axes which are substantially transverse to the longitudinal dimension of the ski 206 through transversely aligned studs 240 and 242 which connect respective legs 236 and 238 to respective side walls 230 of the binding carrier. The rearward end of each of the transversely spaced legs 236 and 238 includes a spring member retaining section 244 which is spaced vertically from the deck 204 of the cable post 202. Compressed spring members 246 are retained between the retaining sections 244 and the deck 204 to provide a biasing force against the legs 236 and 238 in the direction of arrow 248 (FIG. 13). This biasing force acts to bias the bottom rear edge 249 of each leg 236 and 238 (only one rear edge being shown in FIG. 13) against inwardly directed abutments (not shown) provided on the transversely spaced side members 216 and 218 of the binding carrier 210.

Referring to FIGS. 11 – 13, the binding carrier 210 includes an extended lip 250 which is an integral part of the upstanding sections 227 of said binding carrier. The extended lip 250 is adapted to support the bottom of a ski boot 251, and said sole is retained on the extended lip 250 by a boot retaining clip 254. The boot retaining clip 254 is part of a boot retainer 256 (FIGS. 11 and 13) which is identical in construction to the boot retainer 66 described in connection with the FIG. 1 embodiment.

Referring to FIGS. 11 – 13, the boot retaining clip 254 is locked in engagement with the boot 251 and is released from said boot by the action of transversely spaced sets of toggle links which are identical to the sets of toggle links described above in connection with FIG. 1. Specifically, each set of toggle links includes two links 258 and 260. The links 258 and 260 are joined together at overlapping ends by transversely aligned studs 262 which terminate inside of the toggle link support legs 236 and 238. A transversely disposed axle 264 connects the opposite ends of the transversely spaced links 258 together and extends through transversely spaced legs of a retaining link 266 to which the boot retainer 256 is connected. The axle 264 extends in overlying relationship with the upper surfaces of the legs 236 and 238 (FIG. 12). A transversely disposed axle 268 (FIG. 13) extends through ends of links 260 opposite the ends which are connected to link 258. This axle also extends through the transversely spaced upstanding toggle link support legs 236 and 238 to form a connection between the toggle linkage system and said support legs. A transversely extending axle 270 (FIG. 13) also extends through the upstanding legs 236 and 238, then passes through transversely spaced sections of the retaining links 266 to provide a pivot axis for the boot retainer 256 relative to said legs.

Toggle stops, or pins (not shown), identical to pin 98 (FIG. 3), extend inwardly from the transversely spaced toggle link support legs 236 and 238. A tensioned spring member 272 (FIGS. 11 and 12) is connected to the transversely extending axle 264 and 268 to urge the links into a locked condition against the toggle stops. In this condition, the transversely aligned studs 262 are in an overcenter position relative to the line of force imposed upon the axles 264 and 268 by the tensioned spring member 272. From the above description it should be apparent that the toggle linkage system in this embodiment of the invention is identical to the toggle linkage system described eariler in connection with FIG. 1. Also, the toggle linkage system is connected to the retaining link 266 and to the toggle link support legs 236 and 238 in the same manner that the toggle linkage system described in connection with FIG. 1 is connected to the retainer link 66 and the toggle bracket 54.

Referring to FIGS. 12 and 13, identical cam members 274 and 276 are freely rotatable on the transversely extending axle 268 (FIG. 13) intermediate the links 260 and respective adjacent support legs 236 and 238. The cams 274 and 276 are identical in construction to the cams 102 and 104 described in connection with the embodiment disclosed in FIG. 1, and are connected together by a rod 278 (FIG. 13) in the same manner that rod 106 connects the cam members 102 and 104 together. A single cable 280 is connected to the rod intermediate its free ends, and to the raised abutment 228 of the lower deck 204 of cable post 202 (FIGS. 13 and 14). Transversely extending pins 282 are connected to each of the links 260, and these pins overlie respective cams 274 and 276 (FIG. 12).

Referring to FIGS. 12 and 15, the binding carrier 210, which carries the toggle link support legs 236 and 238, is rotatable about a vertical axis provided by stud 212. This stud is mounted into a suitable bearing provided in the upper surface of the ski 206, and a swivel bracket 284 is rotatably connected thereto. The swivel bracket 284 has a rear section which includes transversely spaced, longitudinally extending recesses 286 therein. The extended lip 250 of the binding carrier 210 includes longitudinally extending, downwardly directed ribs 287 which are received within the recesses 286 of the swivel bracket 284 to provide cooperating surfaces which aid in transmitting rotational forces from said swivel bracket to said binding carrier. The swivel bracket 284 terminates rearwardly in the transverse pins 288, 292 and the center pin 290, which pins slidingly interfit and engage within vertically elongated holes provided in the binding carrier 210.

Referring to FIG. 12, the swivel bracket 284 can terminate adjacent the vertical stud 212, as illustrated by the phantom curve 296. Alternatively, the swivel bracket can extend forwardly of stud 212, as shown in solid lines, and can be connected to a binding adapted to receive the toe of the boot.

The toe binding can be of any conventional type, or alternatively, it can be of the same type as the safety ski binding 200. When the swivel bracket 284 connects the toe and heel bindings together the entire boot sole will be isolated from the surface of the ski to minimize the frictional effects among the ski boot, ski and binding which tend to adversely affect the reliability of the release action of said bindings.

The operation of the safety ski binding 200 will now be described.

When an upward normal force of sufficient magnitude to overcome the biasing action of the compressed spring members 246 acts upon the boot retaining clip 254, the toggle link support legs 236 and 238 will be rotated in a clockwise direction, as viewed in FIG. 13, about the transverse axis provided by studs 240 and 242. During this rotational motion, the cable 280 connected to the rod 278 joining cams 274 and 276 together will cause the rod to remain in the same position in relation to the mounting section 202 of the ski binding. However, axle 268, by virtue of being connected to the legs 236 and 238, will also rotate about the transverse axis provided by the studs 240 and 242. This rotational motion of the axle 268 will cause the cams 274 and 276 to rotate about said axle into engagement with the transversely extending pins 282 connected to the toggle links 260. As the cams continue to rotate they will force the transverse axis provided by studs 262, which studs join adjacent ends of the toggle links of each set together, into an undercenter position with respect to the line of force imposed between the axle 264 and 268 by the tensioned spring member 272. After the studs 262 are moved to their undercenter position the force imposed upon the links by the tensioned spring member 272 will positively and reliably cause the links to snap up into a boot releasing position substantially identical to that shown in FIG. 7. In the releasing position of the toggle links the boot retaining clip will be disengaged fro the boot as a result of the rotation of the boot retainer 256 about the transversely extending axle 270.

From the above description, it can be seen that the retaining clip 254 of the safety ski binding 200 releases from the ski boot in the same manner as the retaining clip 70 of the safety ski binding 10. Accordingly, the ame advantages are achieved by the release action of the safety ski binding 200 as are achieved in the eariler described embodiment of this invention. Therefore, these advantages will not be repeated herein.

When a pure transverse force of sufficient magnitude to overcome the biasing action of one of the spring members 232 acts on the boot retainer 256 through its force transmitting connection with the boot retaining clip 254, the binding carrier 210 will rotate in either a clockwise or counterclockwise direction about the stud 212. Either rotation will tension the cable 280 to pull upon the rod 278 which connects the cams 274 and 276 together. This will cause the cams to rotate about the transversely extending axle 268 into contact with the pins 282 which are connected to the links 260. Continued rotation of the cams will force the studs 262 from their overcenter and locked position into an undercenter position. When the studs are in their undercenter position the force imposed between the axles 264 and 268 by the tensioned spring member 272 will snap the links into a boot releasing position substantially identical to that shown in FIG. 7.

From the above description, it can be seen that the retaining clip 254 will move in the same manner to release a boot from a ski when either normal or transverse forces exceed a desired level. Moreover, the safety ski binding 200 will release from the boot when the resultant of both normal and transverse forces exceeds a predetermined level, in the same manner as described above in connection with the earlier embodiments of this invention. Accordingly, no further discussion of this mode of operation of the safety ski binding 200 is considered to be necessary. The modification similar to FIG. 10 can also be used with binding 200. Moreover, all sliding friction between the elements of binding 200 has also been eliminated.

What is claimed is:

1. A safety ski binding including a. a boot retaining member for engaging a ski boot at the heel or toe thereof;

b. operating means operably connected to the boot retaining member and movable between a locked position for forcing the retaining member against the boot to retain the boot on the ski, and an unlocked position for releasing the retaining member from the boot to permit the ski boot to separate from the ski;

c. support means for the operating means movable relative to a ski in two directions;

d. first biasing means for resisting the displacement of the support means relative to the ski in one of said two directions;

e. second biasing means for resisting the displacement of the support means in the other of said two directions;

f. actuated means movable to unlock the operating means for permitting said operating means to move into its unlocked position for releasing the retaining member from the ski boot when the support means moves a certain distance in either one or both of said two directions.

2. The safety ski binding of claim 1 wherein the operating means comprise toggle linkage means.

3. The safety ski binding of claim 1 wherein the operating means comprise a four-bar linkage system.

4. The safety ski binding of claim 1 wherein the first biasing means is preloaded.

5. The safety ski binding of claim 1 wherein the second biasing means is preloaded.

6. The safety ski binding of claim 1 wherein the first and second biasing means are preloaded.

7. The safety ski binding of claim 4 wherein the first biasing means comprise a pair of spring members.

8. The safety ski binding of claim 7 and adjusting means to individually vary the preload on the spring members for clockwise or counterclockwise rotation.

9. The safety ski binding according to claim 1, wherein said support means is rotatable about a first axle generally perpendicular to the upper surface of the ski, and a second axle generally parallel to the upper surface of the ski and extending transversely of the longitudinal dimension of said ski.

10. The safety ski binding according to claim 9, including a transverse axle operatively connecting the operating means to the boot retaining member, said boot retaining member being rotatable about said axle between a position in which it is forced against the boot to retain the boot on the ski, and a position in which it releases from the boot to permit the boot to separate from the ski.

11. The safety ski binding according to claim 9, wherein a projection of the first axle intersects the sole of a ski boot which is retained on the ski.

12. The safety ski binding according to claim 9, wherein the projection of the first axle does not intersect the sole of a ski boot retained on the ski.

13. The safety ski binding according to claim 10, including a generally horizontally extending section connected to the support means and disposed in underlying relationship with the boot retaining member for supporting the bottom surface of the boot sole in a region which is vertical aligned with the boot retaining member.

14. The safety ski binding according to claim 13, wherein said generally horizontally extending section supports the entire bottom surface of the boot sole.

15. The safety ski binding of claim 1 and actuating means for moving the actuated means to unlock the operating means.

16. The safety ski binding according to claim 1, wherein said support means includes a binding carrier rotatably connected to a mounting section about an axis of rotation generally perpendicular to the upper surface of a ski, and toggle bracket means rotatably connected to said binding carrier about an axis of rotation generally transverse to the long dimension of said ski, said toggle linkage means being connected to said toggle bracket means.

17. The safety ski binding according to claim 16 wherein said boot retaining member engages the boot at the heel thereof, said mounting section being movable along the longitudinal direction of the ski in a slide member which is secured to said ski, and biasing means for forcing the mounting section toward the heel of the boot for forcing the toe of the boot into engagement with a toe retaining member.

18. The safety ski binding according to claim 16, wherein the boot retaining member is positioned for engaging the heel of the boot.

19. The safety ski binding according to claim 16, wherein the boot retaining member is positioned for engaging the toe of the boot.

20. The safety ski binding according to claim 2, said toggle linkage means comprising at least part of a four bar linkage system in a two linkage toggle arrangement, one of said toggle arrangement having one end thereof rotatably connected to one end of the boot retaining member through a first axle, the other end of said one link being rotatably connected to one end of the other link through a second axle, the other end of said other link being rotatably connected to the support means through a third axle, a toggle link biasing means acting between the first and third axles to force the second axle into an overcenter and locked position or an undercenter and released position, depending upon the line of action of the force imposed by the toggle link biasing means in relation to the position of the second axle, said actuated means being movable into engagement with at least one of the toggle links for moving the second axle from its overcenter position to its undercenter position to release the retaining member from the boot sole.

21. The safety ski binding of claim 20 wherein one of said axles is transverse.

22. The safety ski binding of claim 20 wherein the axles are parallel.

23. The safety ski binding according to claim 20 wherein said actuated means includes at least one cam rotatably secured to the third axle, said actuating means including a cam retention means for maintaining a section of the cam in a fixed position relative to the upper surface of the ski when the support means moves in either one or both of said two directions, whereby movement of said support means in said one direction causes said cam means to rotate about the third axle into engagement with at least one of the toggle links.

24. The safety ski binding according to claim 23 wherein said actuating means includes force modification means for rotating the cam means about the third axle when the support means moves in the other of said two directions for moving the cam means into engagement with at least one of the toggle links.

25. The safety ski binding according to claim 1, wherein either one or both of said first and second biasing means imparts a displacement resisting force to the support means which is proportional to the displacement of said support means relative to the ski.

26. The safety ski binding according to claim 1 wherein either one or both of said first and second biasing means imparts a displacement resisting force to the support means which is a function of the rate of displacement of the support means relative to the ski.

27. The safety ski binding of claim 1 wherein the two said directions are perpendicular.

28. A safety ski binding including:

a. a support means connectable to a ski for movement relative to said ski in two directions which are perpendicular to each other;

b. a boot retaining member rotatably connected to the support means for movement into and out of engagement with a ski boot at the heel and/or toe thereof;

c. a linkage system disposed in a two link toggle arrangement, one link of said toggle arrangement having one end thereof rotatably connected to the boot retaining member through a first axle, the other end of said one link being rotatably connected to one end of the other link of the toggle arrangement through a second axle, and the other end of said other link being rotatably connected to the support means through a third axle;

d. a toggle link biasing means acting between the first and third axle to force the second axle into an overcenter and locked position or an undercenter and released position depending upon the line of action of the force imposed by the toggle link biasing means in relation to the position of the second axle;

e. biasing means for resisting the displacement of the support means relative to the ski in both of said two directions;

f. actuated means movable into engagement with the linkage system for moving the second axle from its overcenter position in which it forces the retaining member against the boot to retain the boot on the ski to its undercenter position for releasing the retaining member from the boot when the support means moves a certain distance in either one or both of said two directions relative to the ski.

29. The safety ski binding of claim 28 wherein one of said axles is transverse.

30. The safety ski binding of claim 28 wherein all of said axles are transverse.

31. The safety ski binding of claim 28 wherein the biasing means is preloaded.

32. The safety ski binding of claim 28 and actuating means connected to the actuated means to release the linkage system when the support means moves a predetermined distance.

33. The safety ski binding according to claim 28 wherein said support means is rotatable about a vertical axle generally perpendicular to the upper surface of the ski, and a transverse axle generally parallel to the upper surface of the ski and extending transversely of the longitudinal dimension of said ski.

34. The safety ski binding according to claim 33, wherein said support means includes a binding carrier rotatably connected to the mounting section by the vertical axle and a toggle bracket means rotatably connected to the binding carrier by the transverse axle, said third transverse axle being connected to said toggle bracket means.

35. The safety ski binding according to claim 28, wherein said actuated means includes at least one cam rotatably secured to the third axle, said actuating means including a cam retention means for maintaining a section of the cam a fixed distance from the upper surface of the ski when the support means moves in either one or both of said two directions, whereby movement of said support means in said either one or both directions causes the cam means to rotate about the third axle into engagement with the linkage system.

36. The safety ski binding according to claim 35, wherein said actuating means includes force modification means for rotating the cam means about the third axle when the support means moves in the other of said two directions for moving the cam means into engagement with the linkage system.

37. The safety ski binding of claim 1 wherein at least a portion of the boot retaining member moves away from the boot in a generally longitudinal direction when releasing the boot from the ski, whereby sliding frictional forces are substantially eliminated.

38. The safety ski binding of claim 37 wherein the direction of movement is generally perpendicular to the transverse and normal binding displacements.

39. The safety ski binding according to claim 15 wherein said actuating means includes a quick release bracket for moving said actuated means to unlock the operating means.

40. The safety ski binding according to claim 15 wherein said actuated means and said actuating means are not subjected to any loads prior to the unlocking of said operating means.

41. The safety ski binding according to claim 32 wherein said actuated means and said actuating means are not subjected to any loads until said support means has moved said predetermined distance.

42. The safety ski binding according to claim 1 and means to eliminate all sliding friction between the ski boot and the boot retaining member.

43. The safety ski binding according to claim 1 and means to eliminate friction between the ski and the ski boot and the boot retaining member.

44. The safety ski binding according to claim 1 and means to eliminate all sliding friction within the said safety ski binding.

45. The safety ski binding according to claim 28 and means to eliminate all sliding friction between the ski boot and the boot retaining member.

46. The safety ski binding according to claim 28 and means to eliminate friction between the ski and the ski boot and the boot retaining member.

47. The safety ski binding according to claim 28 and means to eliminate all sliding friction within the said safety ski binding.

* * * * *

UNITED STATES PATENT OFFICE

CERTIFICATE OF CORRECTION

PATENT NO. : 4,055,356

DATED : October 25, 1977

INVENTOR(~~S~~) : Hans deGroot

It is certified that error appears in the above-identified patent and that said Letters Patent are hereby corrected as shown below:

In Column 5, line 61 change, "fexural" to --- flexural ---.

In column 6, line 33, correct "ths" to -- the --.

In column 8, line 36, after "links", insert --- against ---.

In column 10,line 56, change "direction" to --- directions -

In column 11,line 32, change "eariler" to --- earlier ---.

In column 14,line 23, correct "fro" to --- from ---.

In column 14, line 31,change "ame" to --- same ---.

In column 14,line 32, correct "eariler" to --- earlier ---.

In column 16, claim 20, line 30, insert --- link --- after "one".

Signed and Sealed this

*Seventh* Day of *March 1978*

[SEAL]

*Attest:*

RUTH C. MASON
*Attesting Officer*

LUTRELLE F. PARKER
*Acting Commissioner of Patents and Trademarks*